US008432160B2

(12) United States Patent
Smargiassi et al.

(10) Patent No.: US 8,432,160 B2
(45) Date of Patent: Apr. 30, 2013

(54) METHOD FOR ESTIMATING THE WEIGHT OF THE CONTENTS OF A HOUSEHOLD APPLIANCE

(75) Inventors: Enrico Smargiassi, Bologna (IT); Giuseppina Pia Potena, Fabriano (IT); Federica Minni, Falconara Marittima (IT); Fabrizio Concettoni, Cupramontana (IT); Valeria Animobono, Fabriano (IT)

(73) Assignee: Indesit Compnay S.p.A, Fabriano (IT)

( * ) Notice: Subject to any disclaimer, the term of this patent is extended or adjusted under 35 U.S.C. 154(b) by 18 days.

(21) Appl. No.: 12/675,837

(22) PCT Filed: Apr. 2, 2008

(86) PCT No.: PCT/IB2008/000786

§ 371 (c)(1),
(2), (4) Date: Nov. 30, 2010

(87) PCT Pub. No.: WO2009/083760

PCT Pub. Date: Jul. 9, 2009

(65) Prior Publication Data

US 2011/0062952 A1 Mar. 17, 2011

(30) Foreign Application Priority Data

Dec. 27, 2007 (IT) ..... TO2007A0943

(51) Int. Cl.
*G01N 27/72* (2006.01)

(52) U.S. Cl.
USPC ..... 324/226

(58) Field of Classification Search ..... 324/226
See application file for complete search history.

(56) References Cited

U.S. PATENT DOCUMENTS

| | | | | |
|---|---|---|---|---|
| 6,065,170 | A * | 5/2000 | Jang | 8/158 |
| 2006/0053839 | A1 | 3/2006 | Matsushima et al. | |

FOREIGN PATENT DOCUMENTS

| | | | |
|---|---|---|---|
| DE | 8905566 | U1 | 6/1989 |
| DE | 4319614 | C1 | 8/1994 |
| DE | 10 2006 027295 | | 7/2007 |
| EP | 0972874 | A1 | 1/2000 |
| EP | 1094239 | | 4/2001 |
| EP | 1258556 | A1 | 11/2002 |
| EP | 1220961 | B1 | 2/2004 |
| FR | 2169039 | | 9/1973 |
| JP | 09313777 | | 12/1997 |
| WO | WO 02/097374 | | 12/2002 |
| WO | WO 2007/031821 | | 3/2007 |
| WO | WO 2008/012651 | | 1/2008 |

* cited by examiner

*Primary Examiner* — Bot Ledynh
(74) *Attorney, Agent, or Firm* — Cesari and McKenna, LLP

(57) ABSTRACT

A method for estimating the value of the weight of the contents of the oscillating assembly of an electronically controlled household appliance is provided. The oscillating assembly is connected to a frame by a suspension system having a damper. The damper includes at least two mechanical elements adapted to move reciprocally, a magnetic element which detects reciprocal motion, depending upon the distance between the two elements, the magnetic sensor generates an electrical signal. A reading of an initial value of an electric parameter, is taken when the oscillating assembly is empty. A mathematical function is identified on the basis of the initial value and of a plurality of predetermined parameters, which relate the electrical parameter to the weight of the contents. A second reading is taken when contents have been loaded in, and the value of the weight of the contents is estimated by using the mathematical function and electric parameters.

22 Claims, 2 Drawing Sheets

METHOD FOR ESTIMATING THE WEIGHT OF THE CONTENTS OF A HOUSEHOLD APPLIANCE

This application is a United States national application which claims the benefit of the priority date of Dec. 27, 2007, which is the priority date of commonly assigned International Application PCT/IB2008/0003786, which was filed on Apr. 2, 2008, by Enrico Smargiassi for a METHOD FOR ESTIMATING THE WEIGHT OF THE CONTENTS OF A HOUSEHOLD APPLIANCE, upon which the present application is based, and which is incorporated by reference herein.

The present invention relates to a method for estimating the value of the weight of the contents of the oscillating assembly of a household appliance, in particular a washing machine, washing/drying machine or clothes dryer, adapted to carry out at least one treatment on textile items, in particular washing or rinsing or drying or spinning or dyeing. The household appliance is of the electronically controlled type, and the oscillating assembly is connected to the frame of the household appliance by means of a suspension system comprising at least one damper, which in turn comprises at least two mechanical elements adapted to move reciprocally, at least one magnetic element, preferably at least one permanent magnet, and at least one magnetic sensor, preferably a Hall effect or magnetoresistive sensor. The magnetic element and the magnetic sensor are housed in the damper, so as to detect the reciprocal motion of said at least two mechanical elements of the damper. The present invention also relates to a household appliance, in particular a washing machine, washing/drying machine or clothes dryer, adapted to implement said method.

In order to improve the washing performance of a laundry washing machine and optimize water and/or washing agent and/or energy consumption, it is useful to be able to estimate the value of the weight of the textile items loaded in the drum of said washing machine before starting a wash cycle.

Among the various possible methods for estimating the weight of said textile items, it is possible to measure the relative movement of the oscillating assembly of the washing machine with respect to the frame occurring when laundry is loaded into the drum: several types of sensing devices are currently available on the market which are adapted to measure said relative movement and which can be conveniently mounted to a damper of a washing machine, the relative movement between the piston and the cylinder of the damper being used for detecting the relative movement of the oscillating assembly with respect to the frame.

Patent application WO2007/031821 describes a washing machine wherein the relative movement between two mechanical elements (piston and cylinder) of a damper of the washing machine is detected by means of a magnetic sensor (e.g. a sensing device based on the Hall effect) applied to one of the two mechanical elements of the damper, a permanent magnet being applied to the other element.

Patent DE102006027295 describes an algorithm for obtaining a reading of a magnetic sensor such as the one installed in the damper of a washing machine according to patent application WO2007/031821 and for deriving the weight of the contents of the oscillating assembly of the washing machine from said reading. Said algorithm is based on theoretical curves of the suspension system (springs and dampers), which however do not take into account the tolerances of said system that arise once the system has been installed in a certain washing machine and cannot be foreseen a priori. This may lead to systematic errors in the detection of the weight of the contents of the oscillating assembly, since it is not possible to perform a calibration procedure capable of adapting the detection of the magnetic sensor to the different operating conditions of said magnetic sensor when installed in different washing machines (this also applies to machines of the same model).

In addition to the above-mentioned drawback, the algorithm of DE102006027295 also has the further drawback that it cannot take into account the deterioration suffered by the suspension system and/or other components connected thereto, such as the gasket, over the life of the washing machine, said deterioration affecting the detection of the weight of the contents of the oscillating assembly.

The object of the present invention is to overcome the aforementioned problems and/or drawbacks through a method, which is alternative to the one described in DE102006027295, for estimating the value of the weight of the contents of the oscillating assembly of a household appliance, in particular a washing machine, washing/drying machine or clothes dryer, adapted to carry out at least one treatment on said contents, in particular washing or rinsing or drying or spinning or dyeing.

The method according to the present invention is based on the idea of estimating the weight value by starting from identifying a mathematical function that relates the quantities involved to one another according to a measurement taken at no load from time to time, i.e. not stored in advance (e.g. in table format). In other words, a mathematical function $y=f(x)$ is found which relates the measured quantity y, said measured quantity being preferably an electric parameter, in particular voltage, of the electric signal generated by a magnetic sensor, to the quantity x to be determined, said quantity to be determined being preferably the weight of the contents of the oscillating assembly of the washing machine. The quantity x to be determined can thus be quantified directly through the inverse mathematical function $x=f^{-1}(y)$.

Advantageously, the method according to the present invention has been so conceived as to take into account different phenomena which may affect accuracy in the determination of the quantity x after measuring the quantity y, and which may overlap or affect one another. Such phenomena may include: stuck damper; hysteresis in the positioning of the damper; structural tolerances of the household appliance and/or damper; settling of the oscillating assembly after the first few cycles; non-linearity of the magnetic field generated by the permanent magnet; ageing of the household appliance, causing wear of the mechanical parts thereof.

The above-mentioned objects and other objects are achieved through a method for estimating the value of the weight of the contents of the oscillating assembly of a household appliance incorporating the features set out in the appended claims 1 to 16, which are intended as an integral part of the present description.

The present invention also relates to a household appliance adapted to implement the aforementioned method and incorporating the features set out in the appended claims 17 to 21, which are intended as an integral part of the present description.

The method and household appliance according to the present invention will become more apparent from the following detailed description, which should be considered as a non-limiting explanatory example, and from the annexed drawings, wherein.

Figure 2:
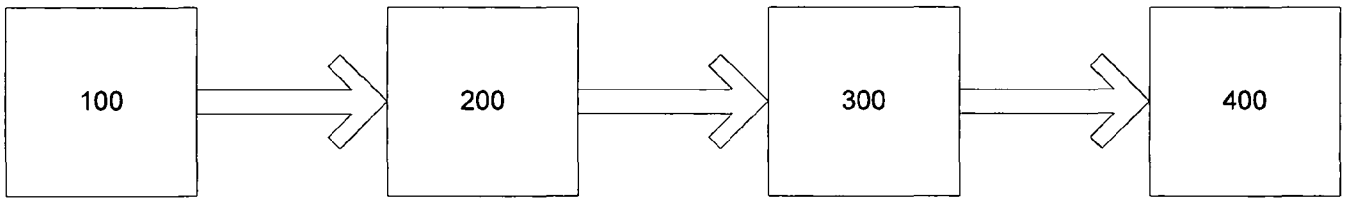
FIG. 2 is a block diagram that describes the method according to the present invention.
Figure 4:
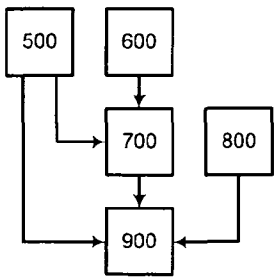
Figure 3:
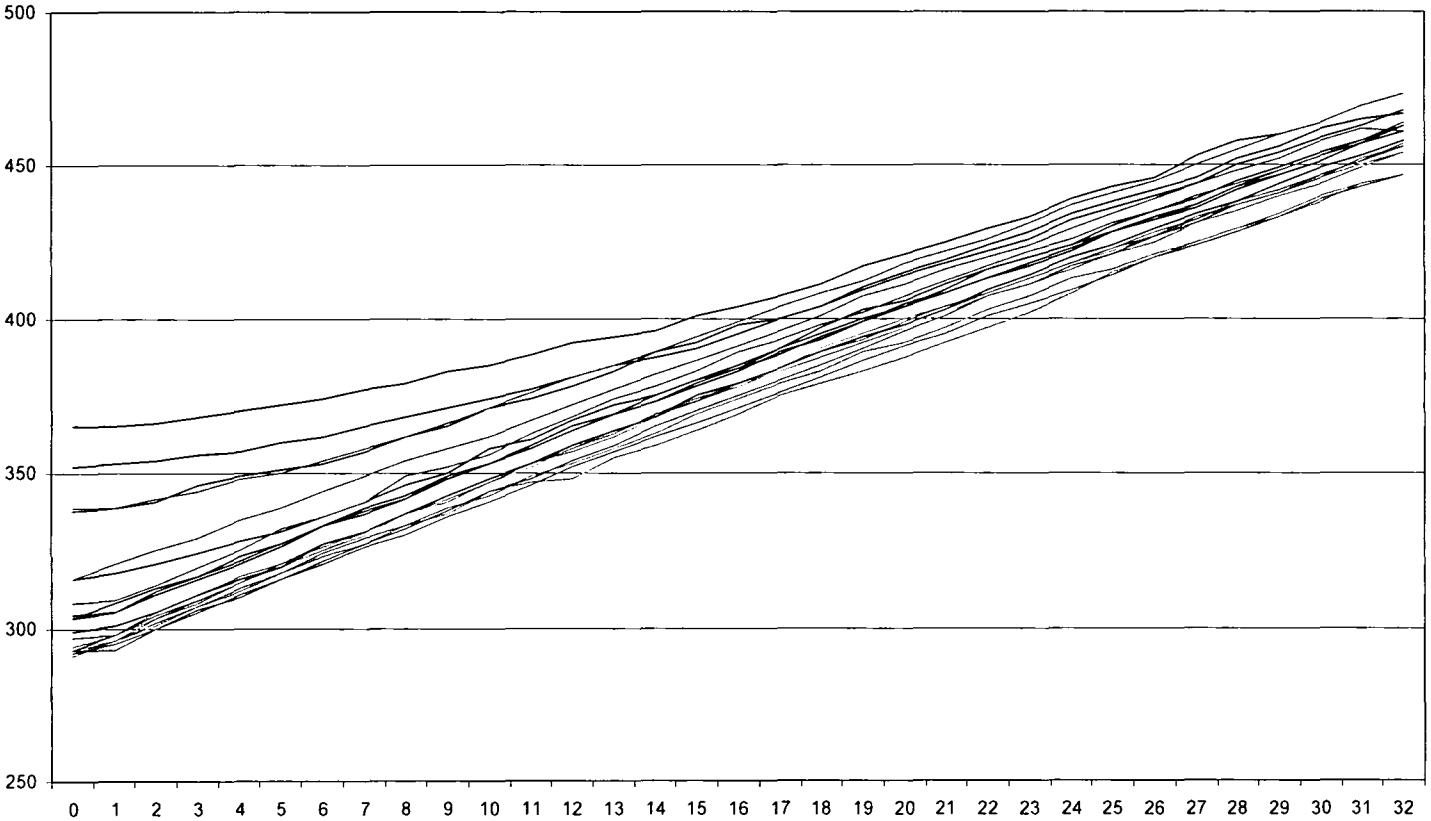

FIG. 3 shows a plurality of curves obtained experimentally, each representing an example of the relationship between an electric parameter of the electric signal generated by the magnetic sensor and the value of the weight of the contents of the oscillating assembly of the household appliance, and FIG. 4 is a block diagram that describes an embodiment of a step of the method according to the present invention, more specifically the step designated by number 200 in FIG. 2.

A household appliance, in particular a washing machine, washing/drying machine or clothes dryer, according to the present invention comprises a frame and an oscillating assembly, in turn comprising a drum adapted to house textile items to be treated and to be rotated about its axis by means of a motor device, and a tub adapted to contain water and/or wash liquid used for performing the treatment. A suspension system keeps the oscillating assembly suspended, while connecting it to the frame. Said household appliance also comprises an electronic control system with a central controller, and possibly also an interface device adapted to provide information to the user of the household appliance. Said interface device may be a luminous device, e.g. an electronic display or a LED array, and/or an acoustic device, e.g. a buzzer or a voice synthesizer.

A washing machine or washing/drying machine or clothes dryer according to the present invention comprises, within its suspension system, dampers connected to the oscillating assembly through a top mount and to the frame through a bottom mount hinged to a pin, which dampers provide the fundamental function of damping the oscillations of the oscillating assembly, especially during the spin phases. Said dampers comprise a cylinder, i.e. a cylindrical tubular element, within which a piston, which typically is also a cylindrical tubular element, slides and is braked by an element capable of generating adequate friction between the outer surface of the piston and the inner surface of the cylinder. Two different configurations are possible in regard to the installation of the dampers in the washing or washing/drying machine: piston constrained to the oscillating assembly and cylinder constrained to the frame, or cylinder constrained to the oscillating assembly and piston constrained to the frame. The above two different configurations are wholly equivalent for the purposes of the present invention.

Figure 1:
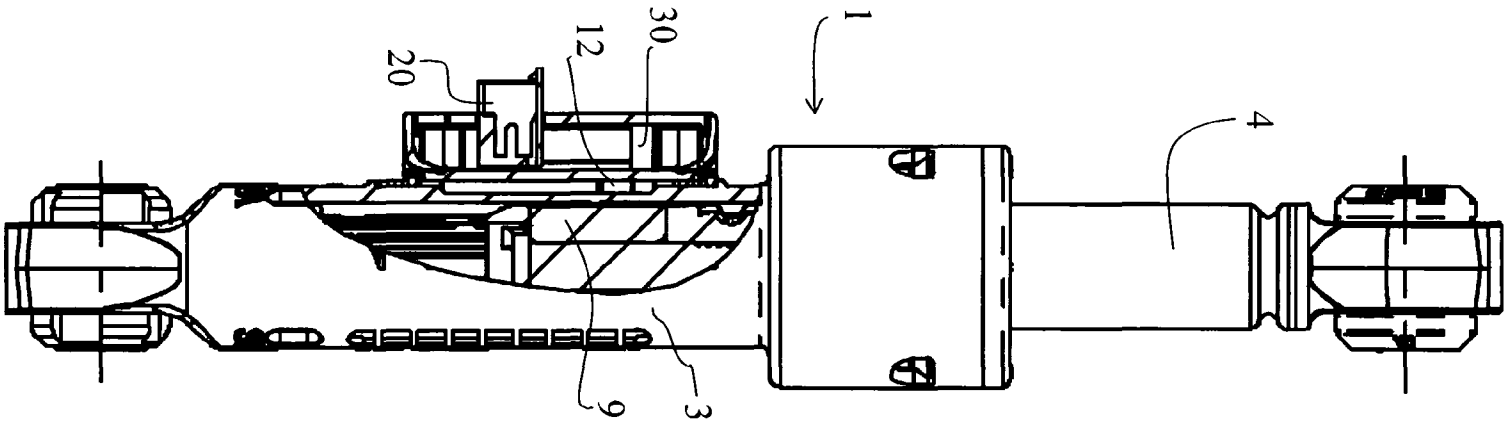
FIG. 1 shows an example of a damper which may be used in a household appliance according to the present invention.

FIG. 1 is a partially sectional axonometry of a damper 1 adapted to be installed in a household appliance according to the present invention. Damper 1 comprises at least two mechanical elements, preferably the first element being piston 4 and the second element being cylinder 3; said two elements are adapted to move reciprocally, in particular the first element being adapted to slide relative to the second element along an essentially straight sliding direction. In the explanatory but non-limiting example of FIG. 1, damper 1 is of the type commonly called "free-stroke" by those skilled in the art, i.e. a damper characterized by a stroke section along which the damper is free to move since no significant resistant force is generated within said section against a predetermined relative movement between said mechanical elements.

A free-stroke damper, which is particularly suitable for use as a damping element in a laundry washing machine, is characterized by a characteristic curve similar to the one shown in FIG. 6 of patent DE102006027295. The range of relative movement between the cylinder and the piston of a free-stroke damper is divided into a first portion (generally called "free zone"), wherein the two elements are free to move with respect to each other without the damper exerting any resistant force, and a second portion consecutive to the first portion in both moving directions, wherein the resistant force of the damper grows considerably as the relative movement between cylinder and piston increases.

In the non-limiting example of FIG. 1, a magnetic element, preferably a permanent magnet 9, is connected to piston 4, said permanent magnet 9 being in particular an axially symmetrical element applied rigidly to the outer surface of piston 4 near the free end of said piston 4, whereas a magnetic sensor, preferably a Hall effect sensor 12, is applied rigidly to cylinder 3; the sensor is thus adapted to measure the relative movement between the first mechanical element and the second mechanical element; as an alternative to the Hall element, one may use at least one Reed switch. The main axis of permanent magnet 9 is substantially parallel to the sliding direction of the first one of the two mechanical elements of damper 1 with respect to the second mechanical element of damper 1. In damper 1 according to the present invention shown in FIG. 1, permanent magnet 9 is connected to piston 4, whereas the magnetic sensor is connected to cylinder 3. Without departing from the scope of the present invention, it would also be possible to connect permanent magnet 9 to cylinder 3 and the magnetic sensor to piston 4.

An electronic board 6 is applied to the surface of cylinder 3, secured thereto, for example, by means of a suitable base. Said electronic board 6 comprises:

- a Hall effect sensor 12, suitable for generating a signal which is representative of the distance between Hall effect sensor 12 and permanent magnet 9;
- processing means, in particular a microcontroller 30, operationally connected to the Hall effect sensor 12 and suitable for generating, starting from the signal received from Hall effect sensor 12, a digital signal which is representative of the distance between the two elements of damper 1, and consequently of the weight of the contents of the oscillating assembly of the washing machine, and
- connection means 20, operationally connected to microcontroller 30 and suitable for ensuring an exchange of information between microcontroller 30 and the electronic control system of the washing machine.

The electronic control system of the washing machine is adapted to generate, instant by instant, at least one piece of information relating to the operating state of the household appliance, said information being usable by said processing means for the purpose of generating the digital signal representing the value of the weight of the contents of the oscillating assembly of the washing machine. It is also conceivable that the estimation of the value of the weight of the contents of the oscillating assembly of the washing machine does not take place by means of microcontroller 30 housed on damper 1, but through a different processing device on board of the washing machine: in such a case, damper 1 may have no processing means of its own.

The washing machine may advantageously comprise means for detecting the value of at least one physical quantity of said laundry treatment, said detection means preferably comprising a conductivity sensor and/or a turbidity sensor and/or a surface tension sensor and/or a pressure sensor and/or a temperature sensor and/or an unbalance sensor and/or a rotation speed sensor. Said detection means, which are operationally connected to the electronic control system of the washing machine, may assist said electronic control system in generating the information relating to the operating state of the household appliance. The electronic control system is suitable for adapting the wash cycle to be carried out by the washing machine as a function of both the reading of Hall effect sensor 12 and the readings of other detection means, if present.

The block diagram of FIG. 2 represents the method according to the present invention, which determines the unknown quantity (e.g. the weight x of the contents of the oscillating assembly of the washing machine) by starting from the measured quantity (e.g. an electric parameter y, in particular voltage, of the electric signal generated by a magnetic sensor, such as the Hall effect sensor 12) through a mathematical function $x=f^{-1}(y)$.

Said method has been developed by the Applicant after experimental studies conducted on the behaviour of a magnetic sensor, such as Hall effect sensor 12, applied to a free-stroke type damper like the one shown in FIG. 1. The Applicant has thus ascertained that the results of said experimental activity may also be extended to the case wherein the magnetic sensor is applied to a different type of damper, by taking into account the existing differences in terms of damper behaviour under the effect of external stress.

FIG. 3 shows a number of load curves obtained during said experimental activity. In the graph of FIG. 3, X axis indicates the estimated weight x of the contents of the oscillating assembly of the washing machine (an Ariston AQXXD169 washing machine was used for the tests), into a damper of which the magnetic sensor and the associated permanent magnet were applied, the former being connected to the cylinder and the latter being connected to the piston. Said weight x is expressed in FIG. 3 by using dimensionless units, each corresponding to a weight of 0.25 kg. Y axis indicates the electric parameter y, in particular voltage, as a digital value dependent on the output voltage of the magnetic sensor. The various curves are differentiated by a different initial position (in the unloaded condition, i.e. with an empty drum) of the permanent magnet with respect to the magnetic sensor (and therefore a different relative position between cylinder 3 and piston 4 of damper 1). Due to the geometry of the damper used for the experimental activity, as well as to the particular arrangement of the magnetic sensor and permanent magnet in said damper, in the non-limiting explanatory example of FIG. 3 there is a shift towards the upper curves as the distance between piston 4 and cylinder 3 decreases.

From the set of curves of FIG. 3 it is apparent that the shape of each load curve is greatly dependent on the initial position of the permanent magnet with respect to the magnetic sensor: some curves can be wholly approximated by a linear function, whereas other curves have a clearly non-linear progress in their initial portion, which can be approximated by a quadratic function (this is in accordance with the behaviour of a free-stroke damper, wherein the range of relative movement between cylinder and piston is divided into a first portion, where the two elements can move relative to each other without the damper exerting any resistant force, and a second portion consecutive to the first portion in both moving directions, where the resistant force of the damper grows considerably as the relative movement between cylinder and piston increases).

FIG. 2 shows the various steps of the method according to the present invention.

Block 100 represents the step of reading an initial value $y_0$ of an electric parameter y, in particular voltage, of said electric signal when the oscillating assembly of the household appliance is empty. Once said reading has been taken, the method proceeds to step 200, wherein, based on the initial value $y_0$ and on a plurality of predetermined parameters (said plurality of predetermined parameters comprising two to ten predetermined parameters, preferably four to six predetermined parameters, more preferably five predetermined parameters), a mathematical function is generated in order to relate said electric parameter y, in particular voltage, to the value of the weight x of the contents of the oscillating assembly of the household appliance, at least a portion of said mathematical function being preferably of the second order (i.e. the significant one for the estimation to be made). It is then assumed that the family of functions describing the relationship between the electric parameter y and the estimated weight x is the following second degree polynomial:

$$y=f(x)=ax^2+bx+c \quad (1)$$

Subsequently, at step 300, a further value $y_1$ of said electric parameter y, in particular voltage, is read after some contents have been loaded into the oscillating assembly.

Finally, at step 400, the weight x of said contents is estimated by using said mathematical function and said further value $y_1$ of the electric parameter.

Steps 300 and 400 are preferably repeated every time some contents are loaded into and/or unloaded from the oscillating assembly of the washing machine.

FIG. 4 shows in detail, by way of non-limiting example, a possible embodiment of step 200. When observing FIG. 4, it can be appreciated that the method according to the present invention is advantageously so conceived as to take into account different physical phenomena (like those listed above) which may affect accuracy in the determination of the unknown quantity (the estimated weight x) after measuring the predetermined quantity (the electric parameter y), and which may overlap or affect one another.

Step 200 includes reading, at block 500, some predetermined parameters which may comprise, by way of non-limiting example:

- a first parameter $\Delta y_0$, representative of the acceptable reading range (often called "active reading range") of magnetic sensor 12 in the absence of load and/or
- a second parameter $\Delta y_\infty$, representative of the acceptable reading range (often called "active reading range") of magnetic sensor 12 at full load (i.e. the maximum load for which the household appliance has been designed) and/or
- a third parameter y*, representative of the minimum value of the acceptable reading range of magnetic sensor 12 in the absence of load and/or
- a fourth parameter m, representative of the slope of the characteristic response function of magnetic sensor 12 when it is operating linearly in the household appliance and/or
- a fifth parameter γ, representative of the curvature of the characteristic response function of magnetic sensor 12 when it is operating non-linearly, said curvature consisting in particular of a deformation index of any of the possible response curves of magnetic sensor 12, calculated against a reference straight line corresponding to a theoretical linear operation of magnetic sensor 12, said fifth parameter γ being determined, by way of non-limiting explanatory example, at or near the minimum value of the reading range of said at least one magnetic sensor 12 in the absence of load in said oscillating assembly.

Some of the aforementioned predetermined parameters are obtained through a calibration procedure which may be carried out on the household appliance at the end of the production line, whereas the remaining ones are determined during the household appliance development stage, based on the physical and geometrical characteristics of the assembly obtained after damper 1 has been installed in the oscillating assembly of the household appliance. In particular, they are obtained when calibrating third parameter y* and fourth parameter m.

As regards the determination of the predetermined parameters, it is carried out by studying and analyzing the curves of FIG. 3.

First parameter $\Delta y_0$ represents the difference between the maximum possible value $y_0^{sup}$ and the minimum possible value $y_0^{inf}$ of the electric parameter y in the absence of load (x=0). It is thus obtained that:

$$\Delta y_0 = y_0^{sup} - y_0^{inf} \tag{2}$$

The second parameter $\Delta y_\infty$ represents the difference between the maximum possible value $y_\infty^{sup}$ and the minimum possible value $y_\infty^{inf}$ of the electric parameter y at full load (assuming x=32 as a full load condition). It is thus obtained that:

$$\Delta y_\infty = y_\infty^{sup} - y_\infty^{inf} \tag{3}$$

The third parameter y* corresponds to the minimum possible value $y_0^{inf}$ of the electric parameter y in the absence of load (x=0). It is thus obtained that:

$$y^* = y_0^{inf} \tag{4}$$

The fourth parameter m represents the slope of the characteristic load curve of the magnetic sensor when the damper is operating within the substantially linear operation range. θ being the angle of inclination of said characteristic curve with respect to the X axis, it is thus obtained that:

$$m = tg(\theta) \tag{5}$$

The fifth parameter γ corresponds to the ratio between the active range of the electric parameter y in the absence of load (x=0), which would be obtained if the active range at full load (x=32) were half the actual range $\Delta y_\infty$, and the actual range $\Delta y_0$ in the absence of load. $y_0^{rif}$ being the starting point corresponding to a final value exactly equal to ½ the active range at full load, it is thus obtained that:

$$\gamma = \frac{y_0^{rif} - y^*}{\Delta y_0} \tag{6}$$

In a simplified embodiment of the present invention, the aforementioned predetermined parameters may be valid along the entire active reading range of magnetic sensor 12. Should a higher resolution of the measurement of the relative distance between magnetic sensor 12 and permanent magnet 9, and thus of the weight x, be desirable, it will be possible, according to an advantageous embodiment, to divide the active reading range in the absence of load of magnetic sensor 12 into a plurality of sub-ranges, so that the first parameter $\Delta y_0$ and/or the second parameter $\Delta y_\infty$ and/or the third parameter y* and/or the fourth parameter m and/or the fifth parameter γ may have different values in the different sub-ranges. This advantageous variant may provide for storing and reading values to/from a table.

In block 600 shown in FIG. 4, intermediate coefficients are determined which allow to calculate the final point $y_f$ (i.e. the estimated value at full load, i.e. the value corresponding to x=32) of the mathematical function that will be defined and used for estimating the weight x by starting from the electric parameter y.

As intermediate coefficients, one may use three coefficients h, k, l, the expressions of which have been obtained from said experimental activity. By way of non-limiting example, some formulae which are suitable for calculating the three intermediate coefficients are listed below:

$$\begin{cases} h = \dfrac{\gamma(2-\gamma)}{2(\gamma-1)} \dfrac{\Delta y_\infty}{\Delta y_0^2} \\ k = \dfrac{\gamma^2 - 2}{2(\gamma-1)} \dfrac{\Delta y_\infty}{\Delta y_0} \\ l = y^* + 32m \end{cases} \tag{7}$$

The method then proceeds to block 700, wherein the final point $y_f$ is calculated as a function of the three intermediate coefficients, and thus indirectly also as a function of the five predetermined parameters. For this calculation, it is assumed that the curvature of the function to be determined increases according to a quadratic law which is a function of the difference between the initial value $y_0$ and the absolute minimum value y*. The final point of each curve therefore depends on the difference $y_0 - y^*$ according to the following quadratic law:

$$y_f = h(y_0 - y^*)^2 + k(y_0 - y^*) + l \tag{8}$$

The mathematical function generation step 200, which is at least partly of the second order and which relates electric parameter y, in particular voltage, to the weight x of the contents of the oscillating assembly of the household appliance, thus ends at block 900, wherein the coefficients a, b, c of the function itself are calculated. In general, said function coefficients depend on the five predetermined parameters, on the initial value $y_0$ and on the final point $y_f$. Since the experimental activity has revealed that the slope of the tangent to the full load curve is substantially equal to the linear progress of the free zone of damper 1, the Applicant has verified that the following formulae, provided herein by way of non-limiting example, are appropriate for determining the function coefficients:

$$\begin{cases} a = \dfrac{32m - y_f + y_0}{896} \\ b = \dfrac{60y_f - 60y_0 - 1024m}{896} \\ c = y_0 \end{cases} \tag{9}$$

The method according to the present invention may suitably take into account any physical phenomena that over time may modify the structure of the washing machine in which damper 1 is installed, thus altering the value of function coefficients a, b, c. Said phenomena comprise, in particular, the settling of the structure, which tends to move the oscillating assembly downwards and which begins after the very first few operating cycles of the washing machine and proceeds asymptotically until stability is achieved after some dozens of cycles, and ageing, which depends on the wear of the mechanical components (plastic catches, gaskets, plastic deformation, and so on) of the washing machine, and which as time goes by inevitably leads to a shift of the balance position of the oscillating assembly.

In order to cope with said physical phenomena, a group of predetermined parameters are modified in the course of the life of the household appliance, preferably by using a corrective function that relates the predetermined parameters belonging to said group to the number of operating cycles of the appliance and/or the operating time of the appliance and/or the trend of the readings of the electric parameter y over time. In particular, said group comprises the third predetermined parameter y*, which is appropriately modified at block 800 before determining the function coefficients a, b, c at block 900.

The present invention offers several advantages. First of all, it allows to overcome the drawbacks of the algorithm according to DE102006027295, because the estimation of the weight of the contents of the oscillating assembly is made more reliable by a calibration procedure capable of adapting the detection activity of the magnetic sensor to the characteristics of the damper and of the household appliance, in particular a washing machine or washing/drying machine or clothes dryer, adapted to carry out at least one treatment on textile items, in particular washing or rinsing or drying or spinning or dyeing, in which said magnetic sensor is installed. Secondly, the present invention advantageously allows to take into account, for the purpose of estimating the weight of the contents of the oscillating assembly, any phenomena which may occur during the life of the household appliance, such as settling, ageing and/or any other deterioration phenomena affecting components of the damper and/or appliance. In the third place, if the household appliance, in particular a washing machine or washing/drying machine or clothes dryer, adapted to carry out at least one treatment on textile items, in particular washing or rinsing or drying or spinning or dyeing, comprises interface means, consisting in particular of a visual interface such as a screen, operationally connected to the magnetic sensor, preferably a Hall effect 12, the present invention makes said household appliance capable of providing the user with useful information as the oscillating assembly is being loaded.

The method according to the present invention may in fact comprise the step of:

v) communicating to the user of the household appliance, through the interface means, at least one piece of information relating to or depending on the estimation of the weight of the contents of the oscillating assembly.

Once it has been finished, step iv) is followed by step v); this step may be carried out automatically every time any contents are loaded into and/or unloaded from said oscillating assembly, or else under a specific request by the user of said household appliance, said request being in particular sent through the interface means (e.g. by pressing an appropriate push-button included in the interface means or by issuing an appropriate voice command).

The information relating to or depending on the estimation of the weight of the contents of the oscillating assembly, which is made available to the user, may comprise:

- the estimated weight of the contents of the oscillating assembly;
- a signal indicating that the maximum load and/or a certain percentage thereof has been reached, the maximum load depending on the specifications of the oscillating assembly and/or on the cycle selected by the user;
- the estimated optimum quantity of washing agents to be supplied to the household appliance, and/or
- the estimated duration of the treatment cycle as a function of the estimated weight of the contents of the oscillating assembly.

The present invention has been described with reference to a particular example of embodiment of the method it relates to, but it is clear that many changes may be made thereto by those skilled in the art without departing from the scope defined by the appended claims. In particular, the formulae used in the present description for determining parameters and coefficients may be replaced with equivalent or alternative ones.

The invention claimed is:

1. A method for estimating a value of a weight of contents of an oscillating assembly of a household appliance, the method comprising:

i) providing one of a washing machine, a washing/drying machine and a clothes dryer, adapted to carry out a treatment on said contents, said household appliance being of a electronically controlled type and said oscillating assembly being connected to a frame of said household appliance by means of a suspension system comprising a damper, said damper comprising:

at least two mechanical elements adapted to move reciprocally, at least one magnetic element, and at least one magnetic sensor, said at least one magnetic element and said at least one magnetic sensor being housed in said damper so as to detect a reciprocal motion of said at least two mechanical elements, said magnetic sensor being adapted to generate an electric signal depending on a distance between said at least two mechanical elements;

ii) reading an initial value associated with a voltage of said electrical signal when said oscillating assembly is empty;

iii) identifying a mathematical function based on said initial value and a plurality of predetermined parameters, said mathematical function relating the voltage to the value of the weight;

iv) reading a further value associated with the voltage of said electric signal after said contents have been loaded into said oscillating assembly, and v) estimating the value of the weight of said contents by using said mathematical function and said further value.

2. The method as defined in claim 1, wherein said plurality of predetermined parameters comprise between two to ten predetermined parameters.

3. The method as defined in claim 2 wherein said predetermined parameters comprise:

at least one of:

- a first reading range of said at least one magnetic sensor when said oscillating assembly is empty;
- a second reading range of said at least one magnetic sensor when said oscillating assembly is in a fully loaded condition;
- a minimum value of the first reading range of said at least one magnetic sensor when said oscillating assembly is empty;
- a slope value of a characteristic response function of said at least one magnetic sensor when it is operating linearly in said household appliance; and
- a curvature value of the characteristic response function of said at least one magnetic sensor, said curvature value being associated with the minimum value of the first reading range.

4. The method as defined in claim 3, wherein a group of said predetermined parameters are obtained through a calibration procedure.

5. The method as defined in claim 3 wherein a group of said predetermined parameters are modified over a life of said household appliance based on a corrective function that relates the group of said predetermined parameters to at least one of:

- a number of operating cycles of said household appliance;
- an operating time of said household appliance; and
- a trend of readings of said electric parameter over time.

6. The method as defined in claim 5 wherein said first reading range is divided into a plurality of sub-ranges, so that a first predetermined parameter and a second predetermined parameter of the predetermined parameters have different values in the sub-ranges.

7. The method as defined in claim 1 wherein at least a portion of said mathematical function is of a second order.

8. The method as defined in claim 1 wherein said steps iv) and v) are repeated every time some contents are loaded into or unloaded from said oscillating assembly.

9. The method as defined in claim 1 further comprising:

providing said household appliance with an interface comprising a visual interface having a screen that is operationally connected to said at least one magnetic sensor; and communicating to a user of said household appliance, through said interface:

at least one piece of information relating to or depending on the estimation of the value of the weight of the contents of said oscillating assembly.

10. The method as defined in claim 9, wherein said at least one piece of information is the estimated value of the weight of the contents of said oscillating assembly.

11. The method as defined in claim 9, wherein said at least one piece of information is a signal indicating that at least one of a maximum load and a certain percentage thereof has been reached, said maximum load depending on specifications of said oscillating assembly and the treatment to be carried out on said contents.

12. The method as defined in claim 9, wherein said at least one piece of information is a quantity of washing agents to be supplied to said household appliance.

13. The method as defined in claim 9, wherein said at least one piece of information is a treatment duration, said treatment duration being determined on a basis of said estimated value of the weight of the contents of said oscillating assembly.

14. The method as defined in claim 9, wherein communicating to a user of said household appliance, through said interface, at least one piece of information is carried out automatically every time some contents are loaded into and/or unloaded from said oscillating assembly.

15. The method as defined in claim 9, wherein communicating to a user of said household appliance, through said interface, at least one piece of information is carried out under specific request by the user of said household appliance, said request being in particular sent through said interface.

16. The method as defined in claim 9 wherein said two mechanical elements are a piston and a cylinder of the damper of the household appliance.

17. A household appliance adapted to carry out at least one treatment on textile items, the household appliance comprising:

an electronic control system;

an oscillating assembly connected to a frame of said household appliance by means of a suspension system having at least one damper, said damper comprising at least two mechanical elements adapted to move reciprocally;

at least one magnetic element and at least one magnetic sensor being housed in said damper so as to detect reciprocal motion of said at least two mechanical elements, said magnetic sensor being capable of generating an electric signal depending on a distance between said at least two mechanical elements, said damper being adapted to estimate a value of a weight of contents of said oscillating assembly using a mathematical function and a further value read after the content has been loaded into said oscillating assembly.

18. The household appliance as defined in claim 17 wherein said damper comprises a free stroke section.

19. The household appliance as defined in claim 17 wherein said damper further comprises an associated processor operationally connected to said at least one magnetic sensor and adapted to receive said electric signal as well as to carry out the following:

i) reading an initial value associated with a voltage; of said electrical signal when said oscillating assembly is empty;

ii) identifying the mathematical function on a basis of said initial value and of a plurality of predetermined parameters, said mathematical function relating the initial value associated with the voltage to the value of the weight;

iii) reading the further value associated with the voltage of said electric signal after said contents have been loaded into said oscillating assembly; and iv) estimating the value of the weight of said contents by using said mathematical function and said further value.

20. The household appliance as defined in claim 19, wherein said electronic control system is operationally connected to said processor and is further adapted to generate at least one piece of information relating to the operating state of said household appliance, said electronic control system being adapted to communicate said at least one piece of information to said processor.

21. The household appliance as defined in claim 17 further comprising:

a detection processor configured to detect a value of at least one physical quantity of a laundry treatment, said detection processor comprising one or more of a conductivity sensor, a turbidity sensor, a surface tension sensor, a pressure sensor, a temperature sensor, an unbalance sensor, and a rotation speed sensor.

22. The household appliance as defined in claim 17 wherein said two mechanical elements are a piston and a cylinder of the at least one damper of the household appliance.

* * * * *

UNITED STATES PATENT AND TRADEMARK OFFICE

CERTIFICATE OF CORRECTION

PATENT NO. : 8,432,160 B2
APPLICATION NO. : 12/675837
DATED : April 30, 2013
INVENTOR(S) : Enrico Smargiassi et al.

It is certified that error appears in the above-identified patent and that said Letters Patent is hereby corrected as shown below:

Title page:
~~Assignee: Indesit Compnay S.p.A Fabriano (IT)~~ should read
Assignee: Indesit Company S.p.A, Fabriano (IT)

Signed and Sealed this
Third Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,432,160 B2
APPLICATION NO. : 12/675837
DATED : April 30, 2013
INVENTOR(S) : Smargiassi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 173 days.

Signed and Sealed this
Eighth Day of September, 2015

Michelle K. Lee

Michelle K. Lee
*Director of the United States Patent and Trademark Office*